US007434346B2

(12) United States Patent
Scherpf

(10) Patent No.: US 7,434,346 B2
(45) Date of Patent: Oct. 14, 2008

(54) SIGHTING DEVICE FOR A FIREARM AND FIREARM WITH AN INSTALLATION POSSIBILITY FOR A SIGHTING DEVICE

(75) Inventor: Christian Scherpf, Obersfeld (DE)

(73) Assignee: Blaser Finanzholding GmbH, Isny im Allgäu (DE)

( * ) Notice: Subject to any disclaimer, the term of this patent is extended or adjusted under 35 U.S.C. 154(b) by 216 days.

(21) Appl. No.: 11/233,403

(22) Filed: Sep. 22, 2005

(65) Prior Publication Data

US 2007/0234627 A1 Oct. 11, 2007

(30) Foreign Application Priority Data

Oct. 6, 2004 (DE) ..... 10 2004 048 907

(51) Int. Cl.
*F41G 3/06* (2006.01)
*F41G 1/38* (2006.01)

(52) U.S. Cl. ..... 42/142; 42/117; 42/119

(58) Field of Classification Search ..... 42/114, 42/117, 122, 123, 142, 119
See application file for complete search history.

(56) References Cited

U.S. PATENT DOCUMENTS 4,993,833 A * 2/1991 Lorey et al. ..... 356/252
6,519,083 B2 * 2/2003 Heinrich ..... 359/422
6,886,287 B1 * 5/2005 Bell et al. ..... 42/120
2005/0252062 A1 * 11/2005 Scrogin et al. ..... 42/119

FOREIGN PATENT DOCUMENTS

DE 28 41 622 A1 9/1978
DE 44 38 955 A1 5/1996
EP 0 311 115 A2 10/1988

* cited by examiner

*Primary Examiner*—Stephen M Johnson
(74) *Attorney, Agent, or Firm*—Martin Fleit; Paul D. Bianco; Fleit Gibbons Gutman Bongini & Bianco PL

(57) ABSTRACT

A sighting device for a firearm exhibits a display device, which is a component of a measuring device for the distance to the target and which displays this target in the field of vision of the marksman. Of the other components of the measuring device, at least one part is not arranged in or on the sighting device. The sighting device exhibits an interface, through which the components of the measuring device arranged in or on the sighting device may be connected to components of the measuring device arranged in or on the firearm in an assembly in accordance with the intended use of the sighting device on the firearm, in such a way that, as a result, collectively a measuring device in working order arises. To this end, the firearm also exhibits a corresponding interface as well, as one of the components of the measuring device.

9 Claims, 1 Drawing Sheet

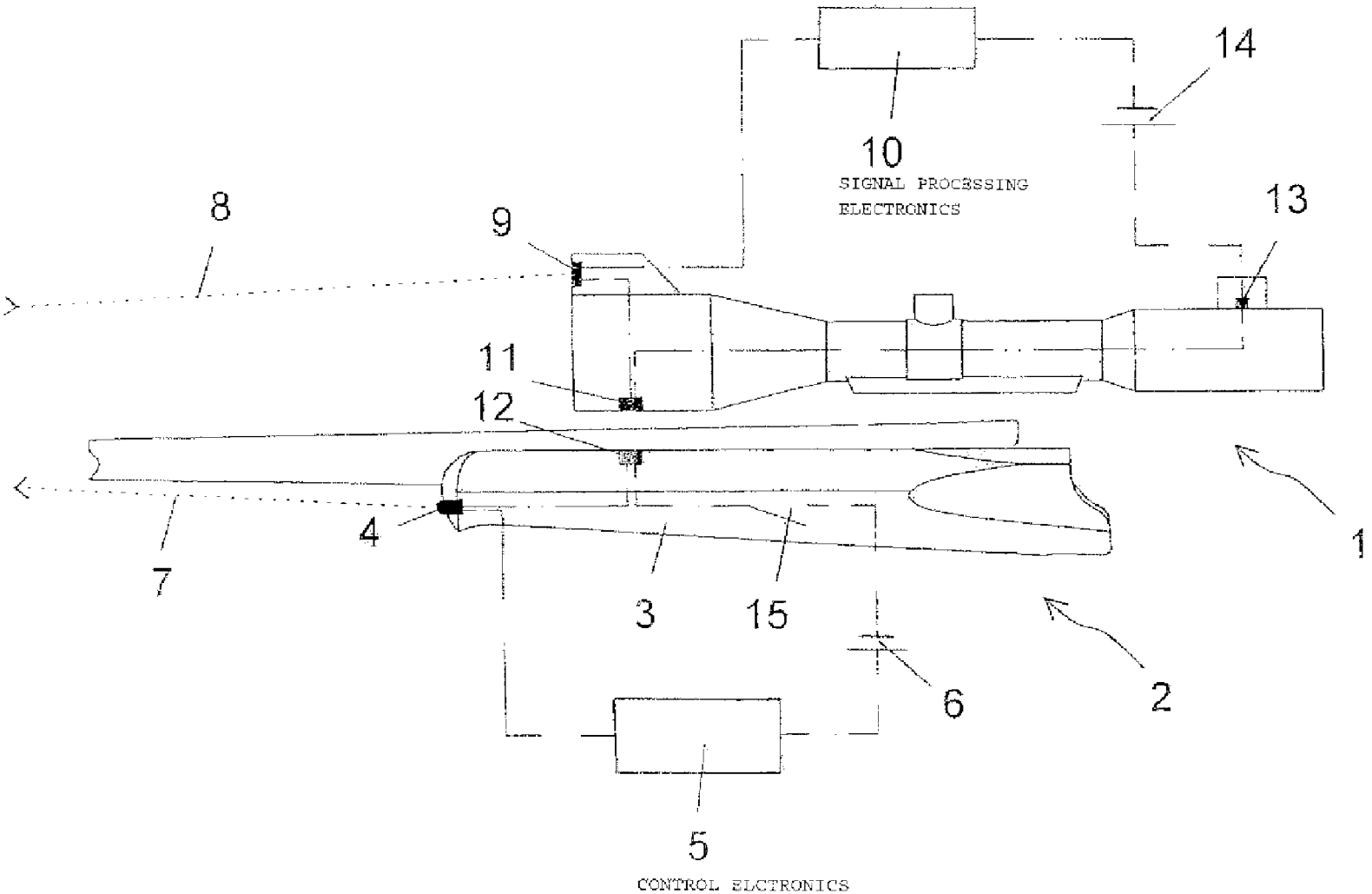
1
2
3
4
5
6
7
8
9
10
11
12
13
14
15
SIGNAL PROCESSING ELECTRONICS
CONTROL ELCTRONICS

SIGHTING DEVICE FOR A FIREARM AND FIREARM WITH AN INSTALLATION POSSIBILITY FOR A SIGHTING DEVICE

FIELD OF THE INVENTION

The invention relates to a sighting device for a firearm, as well as, a firearm with an installation possibility for a sighting device.

BACKGROUND OF THE INVENTION

The correspondence of the point of impact of a firearm with the bull's eye, which the marksman is taking aim at using a sighting device fastened on the firearm, is generally given only for a single distance to the target from the weapon. In general, a firearm is therefore shot at a preferred target distance, i.e., the sighting device, while firing several shots at a target at this distance, is adjusted until said correspondence is achieved. For another target distance, a target different from the intended point of impact must be consciously aimed at by the marksman, or the sighting device must be adjusted in a suitable manner, for which knowledge of the actual target distance is necessary in each case.

SUMMARY OF THE INVENTION

When shooting in the course of hunting, the distance to the target may often be estimated relatively inaccurately by the marksman due to unfavorable lighting conditions or broken terrain, which results in a correspondingly inaccurate impact point. Since fiddling around with a separate distance meter while hunting is undesirable for obvious reasons, sighting devices with an integrated distance meter were developed. Thus, DE 44 38 955 A1 teaches a laser-based sighting telescope with an integrated distance meter. Through the aiming optics, a laser diode radiates a measuring signal which is reflected by the target and is likewise picked up through the aiming optics by a light receiver. Evaluation electronics determine the target distance and control a display unit, whose image is reflected into the field of vision of the marksman. All the components of the distance meter, including its power supply, are arranged within the sighting telescope.

The disadvantage in such sighting telescopes with an integrated distance meter is that, in comparison to conventional sighting telescopes, they inevitably exhibit larger dimensions and greater weight. Furthermore, a distance meter integrated into a sighting telescope must be switched on and off through a switch on the sighting telescope. If the marksman goes into firing position and readies the weapon to fire, without first switching on the distance meter, he must hold the ready-to-fire weapon with one hand in order to switch it on subsequently, which is undesirable from a safety standpoint. The same applies when the distance display in the field of vision disturbs the marksman when actually firing and he therefore wishes to switch it off immediately before this.

In view of this prior art, the task of the invention is to create a solution for measuring the distance while shooting, which facilitates the most compact and lightest construction of the sighting device possible and is distinguished by safe and comfortable operation.

This task is accomplished according to the invention by a sighting device with the features of claim 1 and by a firearm with the features of claim 7. Advantageous embodiments of the invention are specified in the particular subordinate claims.

The central idea of the invention is not to concentrate the components of a distance meter in one sighting device alone but to distribute them in an expedient manner between the sighting device and the firearm. In this connection, a display device is arranged in or on the sighting device in order to display to the marksman the result of the distance measurement in his field of vision. Furthermore, an interface is provided on the sighting device for communication with the external components, i.e., the components allocated to the firearm. A corresponding interface is likewise arranged on the firearm as a counterpart thereto.

Although all components of the distance meter, except for the display device, could theoretically be assigned to the firearm, it is expedient, when measuring on the basis of an optical signal reflected by the target, in particular in the form of a laser beam, to assign these to the receiver of the sighting device because, in this case, its optics can also be used to focus the reflected light on the receiver.

In this case, the sighting device may also be assigned signal processing electronics to evaluate the signal received and to relay to the signal processing electronics via the interface the information still needed to determine the target distance, if necessary. In this case, the sender as well as the control electronics that generates the sending signal may be arranged on the firearm. The advantage in doing this is that, firstly, a direct optical crosstalk from the sender to the receiver is avoided without great expense. Second, the power consumption of the sender, which is generally higher in comparison to that of the receiver, may be covered by its own source of energy in the firearm, in which accommodating batteries in the shaft of a gun is much less problematic than in the housing of a sighting telescope.

A wireless, and in particular an optical implementation appears very expedient for the interface, in which matching the orientation of the two sides to one another is easily attainable due to the accurate, predetermined position of a correctly mounted sighting device on the barrel of a firearm.

A further advantage of the concept according to the invention exists in the possibility of placing a switch for manual on and/or off switching of the measuring device in an ergonomically convenient position, i.e., in particular in the case of a shoulder arm on the stock, where a shoulder arm is normally held with the other hand when firing. In this case, the marksman need not give up the normal firing stance in order to switch the measuring device on or off. Aside from the on/off switch, a manual brightness control for the display device may be provided or combined with the on/off switch.

Furthermore, it is also possible to couple operational organs of the firearm with one or several switches in the service circuit of the measuring device such that the latter is always switched on when the weapon is in firing position, and is then always switched off when the readiness for firing is cancelled. As a result thereof, prompt switching on of the measuring device cannot be forgotten on the one hand, and on the other hand, unnecessary exhaustion of the source of energy is avoided. This override may also be combined with a manual switch, which takes precedence over the override.

BRIEF DESCRIPTION OF THE DRAWING

The sole FIGURE depicts a section of a firearm equipped with a sighting device, in which a distance measuring device according to the invention is distributed between the sighting device and the firearm.

DETAILED DESCRIPTION OF THE INVENTION

The sole FIGURE shows a sighting device 1 in the form of a sighting telescope, which is fastened onto a firearm 2 in the form of a hunting rifle by means of an unillustrated assembly of a known type. The sighting device 1 contains a lens system and a graticule, for example in the form of cross hairs, which are likewise not shown.

Arranged in the stock 3 of the firearm 2 are an optical sender 4 in the form of a laser diode, control electronics 5, which contains a signal generator for generating the signal to be emitted by the sender 4, as well as a source of energy 6 in the form of a battery to supply the sender 4 and the control electronics 5. The signal generator of the control electronics 5 generates a characteristic signal, which is emitted by the sender 4 toward the target by the marksman. For bundling the laser beam 7, a miniature lens system, not illustrated in the figure, may also be provided. The laser beam 8 reflected by the target falls on a receiver 9 arranged in the sighting device 1 in the form of a photodiode or a photodiode array, and after being converted into an electronic signal, is fed to signal processing electronics 10.

One communication interface each in the form of an infrared receiver 11 or an infrared sender 12 is provided on the sighting device 1 as well as on the firearm 2. Infrared communication interfaces of this type are known, for example, from wireless data communication in peripheral devices of personal computers. Although, in principle, any type of wireless communication is possible here, optical communication seems expedient in this respect, in particular, since through the precisely defined position of a correctly mounted sighting device 1 on the barrel of a firearm 2, an exact orientation of the receiver 11 on the sighting device 1 with respect to the sender 12 is provided at the outset on the firearm 2. Due to the wireless connection, connectors become superfluous; though connectors also basically represent a possibility for implementing the system partitioning of a distance measuring device according to the invention, they, are also less attractive for use in hunting weapons from the standpoint of comfort, esthetics, and reliability.

The sending signal generated in the control electronics 5, with which the sender 4 is controlled, is transmitted via the infrared sender 12 and the infrared receiver 11 to the signal processing switching 10 in the sighting device 1. Of course, the time difference between the emission of the laser beam 7 by the sender 4 and the entry of the reflected laser beam 8 on the receiver 9 is proportional to the distance to the target. If the signal transmission times of the sending signal from control electronics 5 to the sender 4 on one hand, and to signal processing electronics 10 on the other hand, as well as the signal transmission time from the receiver 9 to the signal processing electronics 10 are known, then the transmission time of the laser beams 7 and 8, and from that, the target distance, can be determined in the signal processing electronics 10 from the time difference between the arrival of a determined signal pattern from the control electronics 5 and the arrival of the corresponding signal pattern from the receiver 9.

The determined target distance is output from the signal processing electronics on an electronic display device 13. This distance is displayed to the marksman in his field of vision, in which a reflection of the display device 13 is reflected into a suitable focal plane in the beam path of the sighting device 1. Aside from the receiver 9, the signal processing electronics 10 and the display device 13, the sighting device 1 also has a separate source of energy 14 in the form of a battery to supply power to the components of the distance measuring device assigned thereto.

A switch 15 for switching the entire measuring device on and off is arranged on the firearm 2 on the stock 3 of the same, where it is handy for a marksman holding the firearm 2 in firing position. Through the switch 15, not only the part of the distance measuring device assigned to the firearm 2 is switched on and off. Rather, the control electronics 5 also send via the infrared sender 12 and the infrared receiver 11 corresponding command signals to the part of the measuring device assigned to the sighting device 1, whereupon the signal processing electronics 10 activates or deactivates the display device 13 and switches itself over between an active operating status and a standby condition (standby operation) with only minimal power consumption. Here, the switch 15 is illustrated only schematically as a simple on/off switch. Should it also contain a function for regulating the brightness of the display device 13, a corresponding control signal can be transmitted, via the infrared sender 12 and the infrared receiver 11 to the signal processing switch 10, by the control electronics 5 from the position of a switch 15 designed in this case, for example, as a step switch in the time multiplex operation in addition to the signal with which the sender 4 is controlled, whereupon this regulates the brightness of the display device 13 accordingly.

Not illustrated in the sole FIGURE is the possibility of also coupling the switch 15 with functional parts of the firearm 2 such that, by establishing and canceling the readiness for firing, the measuring device is forcibly switched on or off. Such a coupling may be implemented in a simple manner by moving the switch 15 away from the stock 3 toward the vicinity of the locking and trigger mechanisms of the firearm 2 and mechanically coupling therewith. But an additional switch may be provided there, which takes care of said forced on and off switching, and the condition of which switch is linked by the control electronics 5 to that of the switch 15 on the stock 3 such that the forced switching of the manual switch is only superimposed and the operating condition of the measuring device can be manually switched at any time.

The electric circuit or signal paths are indicated in the sole FIGURE only schematically through broken lines. These lines only express the basic existence of connections and do not express, for instance, a particular circuit logic topology of these connections, as in the sense of a ring structure. The electronic or optoelectronic components shown in FIG. 1 are all known as such and their circuit logic connection does not constitute any difficulty in particular for the expert. The most important aspect in the representation is that the components are distributed between the sighting device 1 and the firearm 2 in the manner shown, and that there is only one connection between these two parts in the form of interfaces 11 and 12.

The invention claimed is:

1. A measuring device for measuring distance to a target and displaying the distance in a sighting device of a firearm, the measuring device comprising:

an optical sender disposed directly on the firearm and remote from the sighting device emitting a signal reflected by the target to create a reflected signal;

a receiver disposed on the sighting device receiving the reflected signal;

signal processing electronics connected to said optical sender and said receiver and calculating the distance to the target based on the reflected signal and a signal from said optical sender;

an electronic display device connected to said signal processing electronics and the sighting device for displaying the distance to the target in the sighting device; and an interface connecting said optical sender and said receiver and said signal processing electronics.

2. The measuring device as claimed in claim 1, wherein said interface is a wireless interface.

3. The measuring device as claimed in claim 2, wherein said wireless interface is an optical transmission interface, said opticial transmission interface including a receiver disposed on the sighting device and a sender disposed on the firearm, said receiver and said sender being aligned to communicate an optical signal therebetween.

4. The measuring device as claimed in claim 1, further comprising a source of energy powering said receiver, said signal processing electronics, and said electronic displaying device.

5. The measuring device as claimed in claim 1, wherein said optical sender is disposed directly on a lower surface of the firearm and below a barrel of the firearm.

6. A measuring device for measuring distance to a target, comprising:

a display device disposed on a sighting device for displaying the target, the sighting device being disposed on a firearm, said display device displaying the distance to the target in said sighting device;

an optical sender disposed directly on the firearm and remote from the sighting device emitting an optical signal to the target;

a receiver for receiving the optical signal reflected by the target; and signal processing electronics being connected to said optical sender, said receiver, and said display device, said signal processing electronics calculating the distance to the target based on the signal, and transmitting the distance to said display device.

7. The measuring device according to claim 6, wherein said signal processing electronics are disposed on the sighting device.

8. The measuring device according to claim 6, further comprising:

a wireless transmitter disposed on the firearm and connected to said optical sender, said wireless transmitter transmitting a signal regarding said optical sender; and a wireless receiver disposed on the sighting device and connected to said signal processing electronics, said wireless receiver receiving the signal regarding said optical sender and sending the signal to said signal processing electronics.

9. The measuring device according to claim 8, wherein:

said wireless transmitter is an infrared transmitter; and said wireless receiver is an infrared receiver.

* * * * *